US008938860B2

(12) United States Patent
Suckow et al.

(10) Patent No.: US 8,938,860 B2
(45) Date of Patent: Jan. 27, 2015

(54) SEAL APERTURES THROUGH PACKAGE RECLOSURE

(75) Inventors: Howard Suckow, Roswell, GA (US); Jeffry C. Mauro, Montgomery, NY (US); Kenny E. McCracken, Dacula, GA (US)

(73) Assignee: Illinois Tool Works Inc., Glenview, IL (US)

( * ) Notice: Subject to any disclaimer, the term of this patent is extended or adjusted under 35 U.S.C. 154(b) by 837 days.

(21) Appl. No.: 12/852,178

(22) Filed: Aug. 6, 2010

(65) Prior Publication Data

US 2011/0185543 A1 Aug. 4, 2011

Related U.S. Application Data

(60) Provisional application No. 61/249,835, filed on Oct. 8, 2009.

(51) Int. Cl.

| | |
|---|---|
| ***A44B 19/32*** | (2006.01) |
| ***A44B 19/16*** | (2006.01) |
| ***B65D 33/25*** | (2006.01) |

(52) U.S. Cl.

CPC ..... *B65D 33/2541* (2013.01); *B65D 33/2508* (2013.01); *B65D 33/2533* (2013.01)

USPC ..... 24/30.5 R; 383/63; 383/64

(58) Field of Classification Search

USPC ..... 24/30.5 R, 585.12, 399, 401, 400, 24/DIG. 50; 383/63, 93

See application file for complete search history.

(56) References Cited

U.S. PATENT DOCUMENTS

| | | | | | |
|---|---|---|---|---|---|
| 3,036,894 | A | * | 5/1962 | Forestiere | 436/165 |
| 3,625,270 | A | * | 12/1971 | Skendzic | 383/204 |
| 3,889,871 | A | * | 6/1975 | White | 383/203 |
| 4,007,838 | A | * | 2/1977 | Awad | 206/484 |
| 4,898,280 | A | * | 2/1990 | Runge | 383/200 |
| 4,961,503 | A | * | 10/1990 | Bell | 383/5 |
| 5,044,772 | A | * | 9/1991 | Larson | 383/11 |
| 5,046,621 | A | * | 9/1991 | Bell | 383/5 |
| 5,161,286 | A | * | 11/1992 | Herrington et al. | 24/387 |
| 5,364,189 | A | * | 11/1994 | Kuge et al. | 383/61.2 |
| 5,711,751 | A | * | 1/1998 | Harmanoglu | 493/224 |
| 6,012,844 | A | * | 1/2000 | Huseman et al. | 383/93 |
| 6,068,128 | A | * | 5/2000 | Gardner | 206/554 |
| 6,186,663 | B1 | * | 2/2001 | Ausnit | 383/63 |
| 6,217,216 | B1 | * | 4/2001 | Taheri | 383/207 |
| 6,261,000 | B1 | * | 7/2001 | Bois | 383/120 |
| 6,325,543 | B1 | * | 12/2001 | Ausnit | 383/210.1 |
| 6,364,530 | B1 | * | 4/2002 | Buchman | 383/64 |
| 6,367,976 | B1 | * | 4/2002 | Bannister | 383/85 |

(Continued)

FOREIGN PATENT DOCUMENTS

| | | |
|---|---|---|
| FR | 2 588 246 | 4/1987 |
| WO | 2006/037240 | 4/2006 |

*Primary Examiner* — Robert J Sandy
*Assistant Examiner* — Rowland Do
(74) *Attorney, Agent, or Firm* — McCarter & English, LLP

(57) ABSTRACT

A reclosable zipper is provided having first and second opposing profiles forming at least one pair of opposing flanges. The flanges have cutouts, such as notches or apertures, disposed adjacent to side edges of the profiles so as to define at least one pair of cutouts. When the profiles are sealed to opposing inner surfaces of package panels, portions of the panels seal to each other through the at least one pair of cutouts, providing a reinforcing structure to opposing ends of the zippers, thereby preventing the zipper ends from separating upon opening the package.

7 Claims, 5 Drawing Sheets

(56) References Cited

U.S. PATENT DOCUMENTS

| | | | | |
|---|---|---|---|---|
| 6,398,412 | B2 * | 6/2002 | Wedi et al. | 383/211 |
| 6,409,384 | B1 * | 6/2002 | Provan et al. | 383/5 |
| 6,470,551 | B1 * | 10/2002 | Provan et al. | 29/408 |
| 6,805,485 | B2 * | 10/2004 | Hogan et al. | 383/64 |
| 7,086,782 | B2 * | 8/2006 | Strand et al. | 383/61.2 |
| 7,144,159 | B2 * | 12/2006 | Piotrowski et al. | 383/64 |
| 7,178,309 | B2 * | 2/2007 | Thomas et al. | 53/133.4 |
| 7,207,717 | B2 * | 4/2007 | Steele | 383/38 |
| 7,314,312 | B2 * | 1/2008 | Soderholm | 383/205 |
| 7,409,750 | B2 * | 8/2008 | Machacek | 24/30.5 R |
| 7,470,061 | B2 * | 12/2008 | Plourde et al. | 383/64 |
| 8,070,359 | B2 * | 12/2011 | Taheri | 383/66 |
| 2004/0066983 | A1 * | 4/2004 | Hogan et al. | 383/64 |
| 2004/0146224 | A1 * | 7/2004 | Piotrowski et al. | 383/64 |
| 2007/0066470 | A1 * | 3/2007 | Eads et al. | 493/213 |
| 2007/0199280 | A1 | 8/2007 | Thomas et al. | |
| 2008/0267539 | A1 | 10/2008 | Howell et al. | |

* cited by examiner

SEAL APERTURES THROUGH PACKAGE RECLOSURE

This application claims priority under 35 U.S.C. §119(e) to U.S. provisional application Ser. No. 61/249,835 filed on Oct. 8, 2009, the disclosure of which is incorporated herein by reference.

BACKGROUND OF THE DISCLOSURE

1. Field of the Disclosure

The present disclosure pertains to a zipper or reclosure for a gusseted reclosable package. More particularly, the zipper is configured with apertures, notches or similar structures which enable one or more portions of the package panels to seal against each other so as to reduce the tendency of separating the ends of the zipper when opening the package.

2. Description of the Prior Art

Gusseted and ungusseted reclosable packages or bags are well-developed within the art and adapted for their intended purposes. However, with some reclosable gusseted packages, when a consumer attempts to open the mouth of the package, there is a tendency for the ends of the zipper to separate due to the relatively weak connection created by ultrasonic welding. What may be desired for some applications is a configuration for the reclosable zipper in which the ends of the zipper are reinforced such that there is a reduced tendency of separating the ends of the zipper when opening the package. With such a configuration, in some applications, ultrasonic welding of the ends of the reclosable zipper may be omitted, reducing manufacturing costs.

Prior art includes U.S. Patent Publication No. 2008/0267539 entitled "Sealing Gussets Together Through Apertures in Multi-Wall Paper or Woven Polypropylene Packages or Bags", published on Oct. 20, 2008, listing Howell and Owen as inventors.

OBJECTS AND SUMMARY OF THE DISCLOSURE

It is therefore an object of the present disclosure to provide a reclosable zipper in which the ends of the zipper are reinforced by improved methods such that there is a reduced tendency of separating the ends of the zipper when opening the package.

This and other objects are obtained by providing a reclosable zipper having first and second opposing profiles forming at least one pair of opposing flanges, where the flanges have openings disposed adjacent to side edges of the profiles, so that when the profiles are sealed to inner faces of the package panels, portions of the panels seal to each other through the openings.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
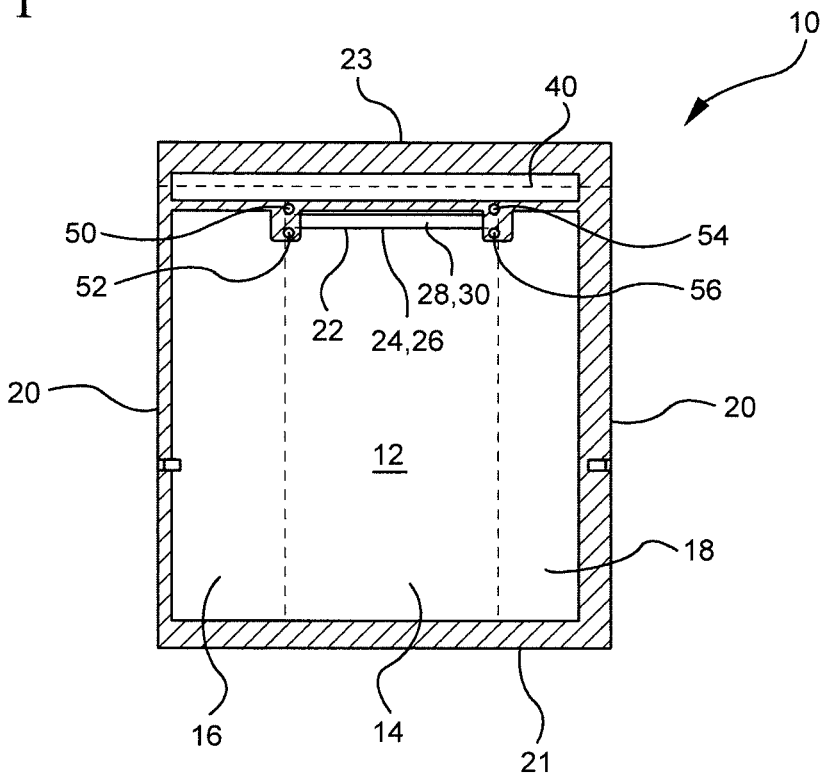
FIG. 1 is a front plan view of a package with a first reclosable zipper configuration.
Figure 2:
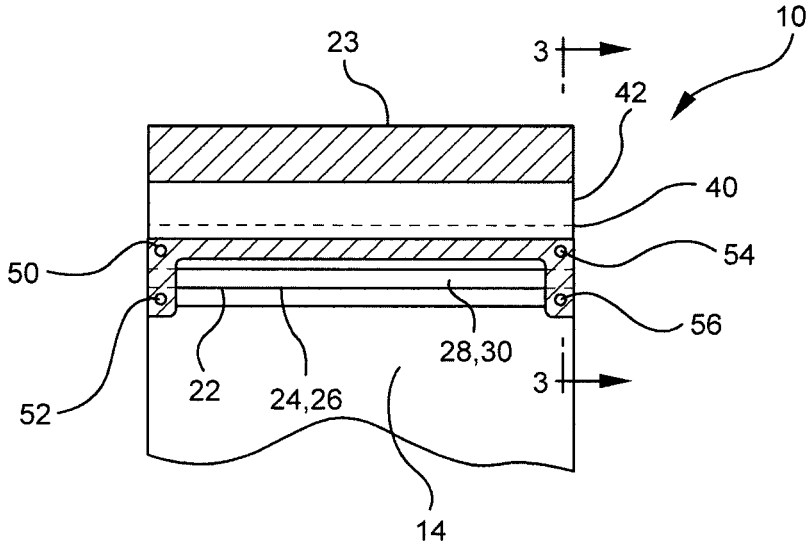
FIG. 2 is an enlarged portion of FIG. 1.
Figure 3:
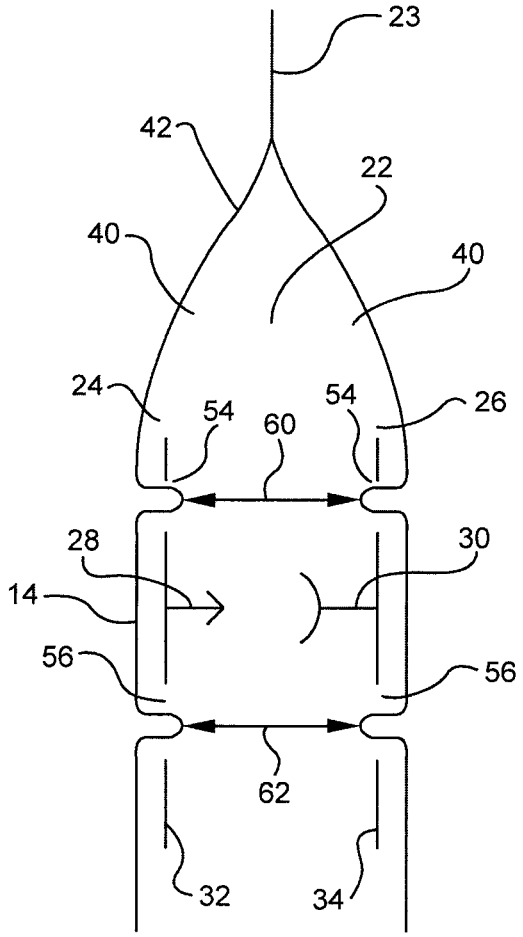
FIG. 3 is a cross-sectional view along plane 3-3 of FIG. 2.
Figure 4:
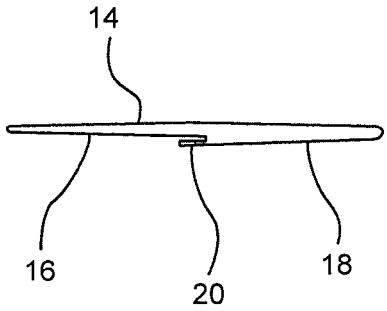
FIG. 4 is a rear view of the reclosable package illustrated in FIG. 1.
Figure 5:
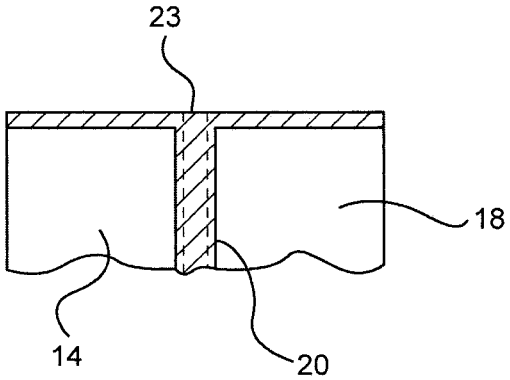
FIG. 5 is a cross-sectional view along plane 5-5 of FIG. 4, illustrating the folding and sealing of the side panels to form the rear walls.

Referring now to the drawings in detail wherein like numbers indicate like elements throughout the several views, one sees that FIGS. 1-3 illustrate a typical reclosable package or bag 10 formed from a single sheet 12 of polymeric or similar material. Single sheet 12 of polymeric or similar material includes a central portion 14 which forms the front panel, and further includes two adjacent side portions 16, 18 that when folded over and sealed together form seal 20 (which may be configured as a lap seal or a fin seal), form the rear panel of the reclosable package or bag 10, and which is likewise indicated on sides of panels 16, 18 in FIG. 1). Bottom seal 21 is likewise formed by sealing the bottom of side portions 16, 18 to the bottom of front portion 14. Likewise, top seal 23 is formed by sealing the top of side portions 16, 18 to the top of front portion 14. Zipper 22, typically formed from polymeric or plastic material, includes first and second zipper profiles 24, 26 with respective first and second interlocking elements 28, 30 (illustrated as male and female, respectively) and first and second flanges 32, 34 extending therefrom. First zipper flange 32 is initially sealed to front panel 14 as shown in FIG. 1 and zipper flange 34 thereafter sealed to side portions 16, 18 after they are folded over and sealed together as shown in FIG. 5, thereby likewise reaching the configuration of FIG. 2.

Line of weakness 40 (which may be formed as a perforation or by laser scoring, but is not limited thereto, and may likewise by implemented as a linear tear line) is formed on sheet of material 12, spanning across portions 14, 16, 18, above zipper 22 and below top seal 23 thereby forming a removable header 42 above line of weakness 40, which may be removed by the user.

As shown in FIGS. 1, 2 and 3, first and second flanges 32, 34 each include first pair of vertically aligned apertures 50, 52 inwardly adjacent from a first end and second pair of vertically aligned apertures 54, 56 inwardly adjacent from a second end, and free of passage through the first and second interlocking elements 28, 30. The apertures 50, 52, 54, 56 formed on first flange 32 are aligned with the apertures 50, 52, 54, 56 formed on second flange 34, and free of passage through the first and second interlocking elements 28, 30. Apertures 50, 54 are typically formed above the first and second interlocking elements 28, 30 and apertures 52, 56 are typically formed below first and second interlocking elements 28, 30. Additionally, the first ends of first and second flanges 32 are typically sealed to each other and the second ends of first and second flanges 32, 34 are typically sealed to each other, typically by, but not limited to, ultrasonic welding. However, in some applications, this sealing of the ends of the flanges to each other may be omitted. As shown in FIG. 3, the front panel (formed from central portion 14) and the rear panel (formed from side portion 16 with respect to first pair of vertically aligned apertures and side portion 18 with respect to second pair of vertically aligned apertures) extend through the apertures 50, 52, 54, 56 and are sealed to each other as indicated by the two arrows 60, 62, both labeled "seal". With this configuration, the reclosable package 10 may be opened (typically by the consumer after removal of the removal header 42 along line of weakness 40). The seals 60, 62 direct opening forces away from the zipper 22 thereby reducing the chances of separation after multiple uses, providing a zipper which is easier for the consumer to align, and protecting the side seals.

Figure 6:
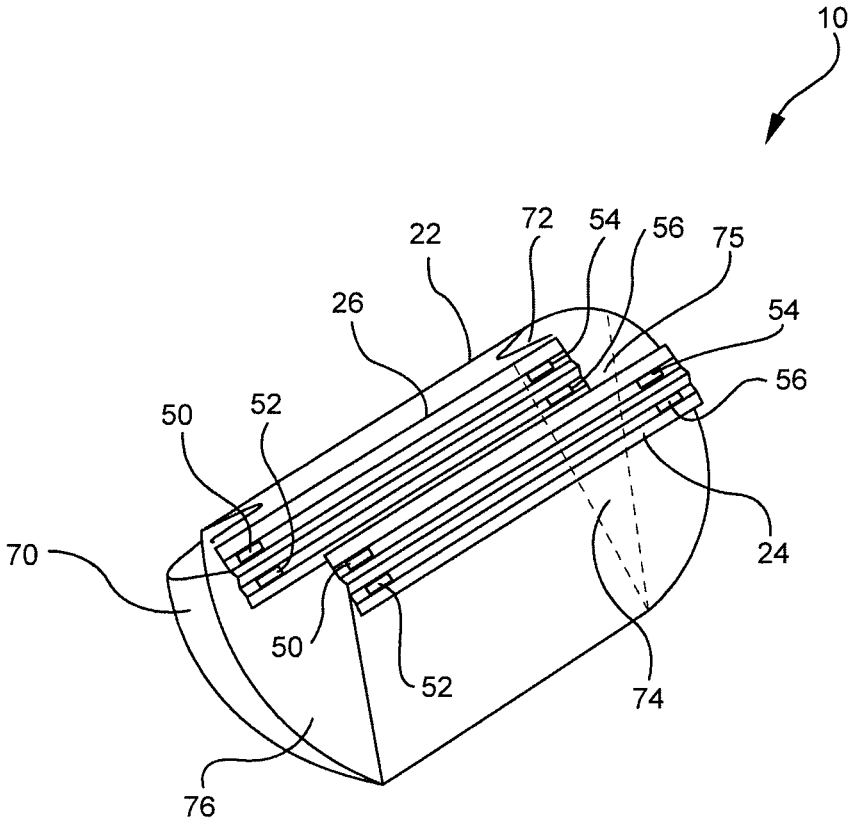
FIG. 6 is a perspective view of a second embodiment the reclosable package.

FIG. 6 discloses an embodiment of reclosable package or bag 10 where first and second gussets 70, 72 are formed behind second zipper profile 26. In other words, both zipper flanges are contained within one of the gusset folds at each end of the package or bag 10. First zipper profile 24 is sealed to the interior of front panel 74, adjacent to the mouth 75 of the package 10. Second zipper profile 26 is sealed over the first and second gussets 70, 72 and to rear panel 76. Additionally, the first and second gussets 70, 72 are sealed to rear panel 76. First and second zipper profiles 24, 26 include first pair of vertical aligned apertures 50, 52 on a first end and second pair of vertically aligned apertures 54, 56 on a second end. Portions of front panel 74 pass through apertures 50, 52 and are sealed to first gusset 70. Similarly, portions of front panel 74 pass through apertures 54, 56 and are sealed to second gusset 72. This provides the benefits described with respect to the embodiment of FIGS. 1-5 while incorporating gussets into reclosable package 10.

Figure 7:
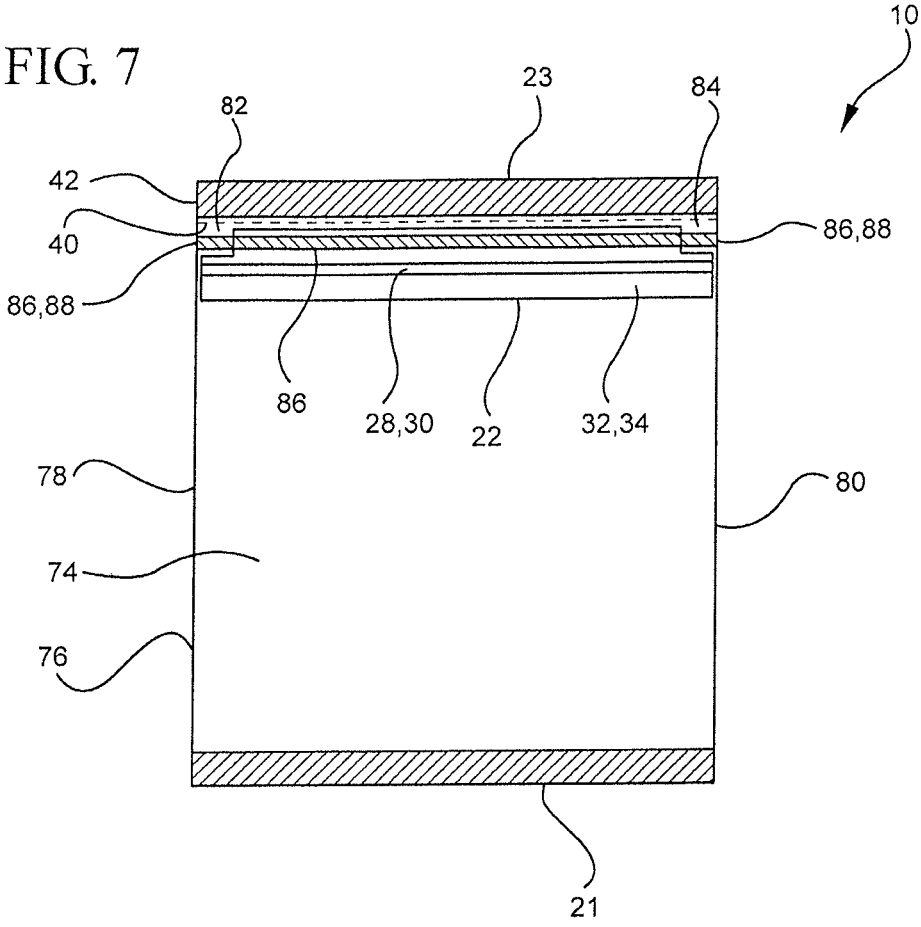
FIG. 7 is a front plan view of a third embodiment of the package with a second reclosable zipper configuration.
Figure 8:
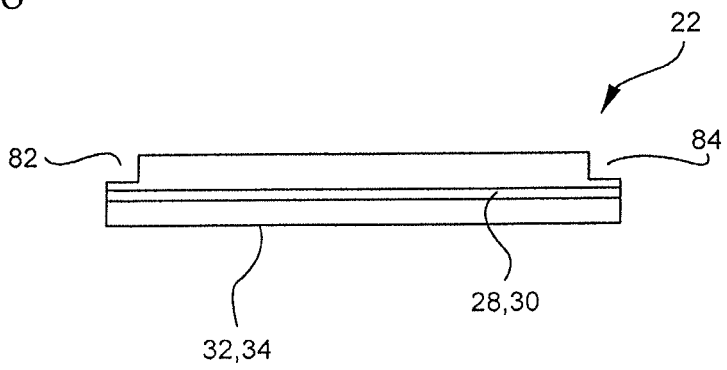
FIG. 8 is a plan view of a zipper of the reclosable package illustrated in FIG. 7.

FIGS. 7 and 8 disclose an embodiment of reclosable package or bag 10 including a front panel 74 and a rear panel 76 joined at a bottom seal 21 and a top seal 23, as well as side seals 78, 80 along the first and second edges thereof. Similar to the embodiment of FIGS. 1-5, a header 42 is formed over zipper 22, and is removable by tearing line of weakness 40 which is formed immediately under top seal 23. As shown in FIG. 8, notches 82, 84 are both formed on the upper portions of ends of first and second flanges 32, 34, above first and second interlocking elements 28, 30. That is, notches 82, 84 are both formed on first flange 32 as well as second flange 34, typically above the first and second interlocking elements 28, 30 and free of passage therethrough. With this configuration, front flange seal 86 (see FIG. 7) is formed across the width of reclosable package 10 between front panel 74 and first flange 32, and likewise rear flange seal 88 is formed across the width of reclosable package 10 between rear panel 76 and second flange 34. Additionally, front and rear flange seals 86, 88 join to each other within notches 82, 84 thereby joining portions of front and rear panels 74, 76 thereby providing the benefits of the apertures as described with the previous embodiments. First flange seal 86 and rear flange seal 86 may be combined, resulting in sealing together front panel 74, first flange 32, rear panel 76 and second flange 34.

It should be noted that the bag wall constructions of FIGS. 1 and 7 are interchangeable so that the construction of FIG. 1 could be used with notches rather than apertures and vice versa. Similarly, a combination of a notch and aperture could replace the apertures above and below the zipper interlocking element of FIG. 1.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable zipper, comprising:

a first profile including a first interlocking element and a first flange;

a second profile including a second interlocking element and a second flange;

the first profile including first and second ends, the first end of the first profile including a first notch thereon and the second end of the first profile including a second notch thereon;

the second profile including first and second ends, the first end of the second profile including a third notch thereon and the second end of the second profile including a fourth notch thereon;

wherein the first, second, third and fourth notches are on a customer side of the zipper, above the first and second interlocking elements;

the first notch being aligned with the third notch thereby being constructed and arranged for opposing sheets of package film to be sealed to each other through the first and third notches; and the second notch being aligned with the fourth notch thereby being constructed and arranged for opposing sheets of package film to be sealed to each other through the second and fourth notches.

2. The zipper of claim 1 wherein the first and second notches are formed on the first flange.

3. The zipper of claim 2 wherein the third and fourth notches are formed on the second flange.

4. The zipper of claim 3 wherein the first, second, third and fourth notches are free of passage through the first and second interlocking elements.

5. The zipper of claim 1 wherein the first and second flanges and the first and second interlocking elements are formed from a polymeric material.

6. The zipper of claim 1 wherein the first ends of the first and second profiles are sealed together and the second ends of the first and second profiles are sealed together.

7. The zipper of claim 1 further including a sealed top over the zipper, and a tear line in the sealed top.

* * * * *